United States Patent [19]

Nielson

[11] Patent Number: 4,856,587

[45] Date of Patent: Aug. 15, 1989

[54] RECOVERY OF OIL FROM OIL-BEARING FORMATION BY CONTINUALLY FLOWING PRESSURIZED HEATED GAS THROUGH CHANNEL ALONGSIDE MATRIX

[76] Inventor: Jay P. Nielson, 3490 Monte Verde Dr., Salt Lake City, Utah 84109

[21] Appl. No.: 263,433

[22] Filed: Oct. 27, 1988

[51] Int. Cl.[4] ..... E21B 43/22

[52] U.S. Cl. ..... 166/272

[58] Field of Search ..... 166/50, 271, 272

[56] References Cited

U.S. PATENT DOCUMENTS

| | | | |
|---|---|---|---|
| 2,970,826 | 2/1961 | Woodruff . | |
| 2,974,937 | 3/1961 | Kiel . | |
| 3,108,636 | 10/1963 | Peterson . | |
| 3,351,132 | 11/1967 | Dougan et al. . | |
| 3,362,751 | 1/1968 | Tinlin . | |
| 3,480,082 | 11/1969 | Gilliland . | |
| 3,513,914 | 5/1970 | Vogel | 166/272 X |
| 3,516,495 | 6/1970 | Patton . | |
| 3,881,551 | 5/1975 | Terry et al. | 166/272 |
| 4,384,614 | 5/1983 | Justheim . | |
| 4,615,392 | 10/1986 | Halligal | 166/272 |

OTHER PUBLICATIONS

E. F. Herbeck et al., Fundamentals of Tertiary Oil Recovery, 1977, pp. 7–36, Energy Communications, Dallas, Tex.

Mark A. Klins, Carbon Dioxide Flooding, pp. 64–73, International Human Resources Development Corp., Boston.

Fred. I. Stalkup, Jr., Miscible Displacement, 1984, pp. 137–141, 147–158, Society of Petroleum Engineers of AIME, Dallas, Tex.

L. A. Johnson et al., Oil Recovery from a Utah Tar Sand Deposit by In Situ Combustion, pp. 63–64, 73–75, U.S. Dept. of Energy, Laramie, Wyo.

M. M. Schumacher, editor, Enhanced Oil Recovery, 1978, pp. 30–43, Hoyes Data Corp., Park Ridge, N.J.

Thurber et al., How Shell Attempted to Unlock Utah Tar Sands, Nov. 1977, pp. 31, 34, 38, 42, Petroleum Engineer.

*Primary Examiner*—William P. Neuder

*Attorney, Agent, or Firm*—Philip A. Mallinckrodt; Robert R. Mallinckrodt

[57] ABSTRACT

The invention comprises a method and apparatus for recovering oil from so-called depleted oil fields and also from tar sands. A pressurized, heated, non-aqueous gas, such as carbon dioxide, is continuously flowed through a channel which is in heat exchange relationship with an oil-bearing matrix, thus reducing the viscosity and mobilizing the oil in the sensible boundary region. Mobilized oil flows to a collection reservoir from which it is then produced.

12 Claims, 4 Drawing Sheets

RECOVERY OF OIL FROM OIL-BEARING FORMATION BY CONTINUALLY FLOWING PRESSURIZED HEATED GAS THROUGH CHANNEL ALONGSIDE MATRIX

BACKGROUND OF THE INVENTION

1. Field

The invention is in the field of methods and apparatus for recovery of oil from underground oil-bearing formations by the introduction thereinto, and continuous flowing therethrough, of a heated non-aqueous gas.

2. State of the Art

An appendix of terms is included at the end of this specification.

Traditionally, oil has been produced from underground oil-bearing formations by a series of processes, the first of which is called the primary phase of oil production. This phase utilizes natural stored energy in or near the formation to move the oil to production wells, and to bring it to the surface, assisted as needed by pumping. When the natural energy is depleted a secondary phase is entered into whereby water under pressure is injected into the formation to supply supplemental energy and to thus force additional oil to move to the wells. When production by this method ceases to be economical a tertiary phase is entered into, spoken of as enhanced oil recovery (EOR). In this phase a variety of methods are employed, such as chemical flooding, gas flooding, steam flooding, in situ combustion, thermal methods, and various combinations of these. A summary of such methods is given in a publication by Herbeck, et al., entitled "Fundamentals of Tertiary Oil Recovery", Energy Communications, Dallas, Tex., 1977.

The combined total oil production by the primary and secondary phases is generally less than 40% of the original oil-in-place. The tertiary phase may recover an additional 10%. Thus, existing methods of oil recovery leave approximately 50% of the oil-in-place behind in the formation. Some experts have predicted that unless some new techniques are developed it will be necessary, about the year 2000 A.D., to mine the formations to recover this oil. This will be very costly since the formations are generally 1,000 to 10,000 feet below the surface of the ground.

The above processes are normally employed in formations in which the viscosity of the oil is relatively low. Recovery of highly viscous oil by these procedures is usually not economical and such procedure cannot be used for the recovery of oil locked in so-called tar sands.

Flooding methods referred to above involve subjecting the matrix to a flood of fluid, under pressure, so as to force the oil from an injection well to a production well. Substantially the entire depth of the matrix in a vertical cross section is subjected to this pressurized flood.

Chemical or micellar solution flooding involves preinjection of a fluid to condition the deposit, followed by injection of a flooding alkaline or alkaline polymer solution that forms surfactants in situ for releasing oil, followed by a polymer solution for mobility control, and a driving fluid, usually water, to move the chemicals and resulting oil to the production well. Pollution problems are severe with this process due to the storage and use of large quantities of polluting chemicals. In addition, the cost is high.

The usual carbon dioxide flooding involves injecting a slug of $CO_2$ followed by alternate water and $CO_2$ injections. The objective is to attain a miscible zone of $CO_2$ and oil at their interface. Otherwise, interfacial tensions cause the oil to form in microscopic droplets which tend to bind to the underground material in the pores thereof. However, $CO_2$ and oil are not miscible at first contact. Dynamic miscibility occurs when the density of the $CO_2$ is sufficiently great that hydrocarbons of the oil are solubilized in the $CO_2$. This requires pressures of 1500 psia to 6000 psia. Also, the oil must have a gravity above about 25° API. A problem also arises from the precipitation of asphaltenes and paraffins due to compositional disturbances caused by the miscible displacement. Such precipitation creates plugging and clogging problems.

Steam flooding involves injecting steam, which condenses to hot water at the interface with the deposit. Being reinforced by steam pressure behind it, the hot water tends to push the oil through the deposit to the production well. This is a popular process but leaves much oil unrecovered.

Cyclic steam stimulation is basically a thermal process wherein steam is injected into a deposit of highly viscous oil in order to introduce heat. The formation is allowed to soak for several days, during which time some of the oil is thinned. The thinned oil is then pumped out of the same well.

Another thermal process involves boring holes in the formation and placing electrical heaters therein to heat the oil for reducing its viscosity. This is a clostly procedure.

Still another thermal process proposed for extracting oil from oil shales involves injecting $CO_2$ that is heated to a temperature of at least 1000° F. and pressurized to a pressure of at least 500 psig into an injection well so as to heat the shale and thus to vaporize and/or entrain the hydrocarbons that result from cracking and/or vaporization and liquefaction and to produce from the formation through a recovery well. This process has been known for many years, but apparently has not been successful.

Yet another thermal process, known as in-situ combustion, involves igniting the oil in a fire flood at an injection well, and, by continued injection of air, causing a fire front to advance through the deposit to a production well.

However, all of these methods and variations thereof leave a large quantity of oil behind as unrecovered. Moreover, many of them require the use of high pressures in the thousands of psia range, which cannot be used in shallow formations due to the danger of fracturing the impervious overburden.

Again, a problem lies in the requirement to maintain a favorable mobility ratio. The ratio of the mobility of the flooding substance to the mobility of the oil must be less than 10, preferably near 1.

Another difficulty lies in the need for very high temperatures, in excess of 1000° Fahrenheit, which is very costly. In addition, for some deposits this results in calcining which causes a prodigious waste of heat.

Mention should also be made of another process involving mining the oilbearing material. The mined material is retorted so as to recover the oil by distillation. This is not economical for most formations and for the obtaining of low priced oil products.

3. Objectives

Principal objectives in the making of the present invention were to develop method and apparatus for substantially increasing the amount of oil-in-place recovered over existing secondary and tertiary methods for oil fields wherein the oil has been depleted to the point that production is no longer economical, and also for extracting highly viscous oil from tar sands and other formations that are not economically processed by existing methods.

SUMMARY OF THE INVENTION

The invention is both a method and apparatus for substantially increasing the percentage of oil-in-place that is recovered from oil fields as compared to that recovered by existing secondary and tertiary methods and apparatus, and is also applicable to the recovery of highly viscous oil from tar sands and other deposits that are not economically processed by existing methods and apparatus.

The method of the invention employs a thermal technique that is unique and distinctly different from secondary and tertiary (EOR) methods presently employed or proposed.

In this invention, a communication channel between two wells is employed. If one already exists, it is used; if not, one is established in one way or another as indicated hereinafter. Such channel is substantially depleted of liquid, e.g., water or oil, leaving the channel pervious to gas flow between the two wells. The channel should lie alongside, or pass through, an oil-bearing reservoir, such that there is a sensible boundary between the channel and the oil-bearing reservoir providing a heat exchange relationship between the two.

Each terminus of the channel communicates with a collection reservoir which surrounds and extends to the bottom of a well. Each collection reservoir comprises the lower portion of a well bore and a surrounding region of porous underground material that is substantially depleted of water and oil. Each well extends from a point at or near the bottom of the oil-bearing reservoir to the surface of the ground.

A pressurized and heated non-aqueous gas such as carbon dioxide, nitrogen, or a mixture thereof, is injected into one well, made to flow through the channel to the other well, and preferably extracted therefrom, reheated, repressurized, and recycled. The temperature of the heated gas is high enough to significantly reduce viscosity but not so high as to cause vaporization or pyrolysis of significant quantities of the oil. In addition, the temperature and pressure are kept low enough to avoid miscibility.

As the heated gas flows through the channels it imparts heat to the oil-bearing reservoir, thus reducing the viscosity of the oil in regions at or near the sensible boundary of such channel, so that the oil becomes mobile, whence it flows to one or both of the collection reservoirs, from which it is then extracted by way of a conduit in the well. In addition, as the carbon dioxide flows through the channel, some of it in the sensible boundary region dissolves into the oil, thus further reducing the viscosity of the oil.

As gas is continually flowed through the channel, the oil at or near the sensible boundary becomes mobile, and flows into the collection reservoirs under the influence of gravity and pressure, leaving voids and pores behind. These voids and pores then become a part of the channel through which the heated gas flows and thus a new sensible boundary is established between the now enlarged channel and fresh regions of the oil-bearing reservoir. The process is a continuous one in the sense that gas is continually flowed along and in heat exchange relationship with a sensible boundary of the formation. From time to time it may be found advantageous to reverse the direction of flow of the gas between the two wells.

For some formations, a channel will exist naturally. For other formations, the channel must be established. This can be accomplished in various ways, such as by subjecting a strata in the formation to repetitive heat and pressure shocks, thus effecting cracks and fissures, and mobilizing and extracting the oil and connate water, leaving behind a porous channel substantially void of oil and water. Another method involves injecting heated and pressurized $CO_2$ into a well, dissolving some of it into available oil, releasing the pressure, thus causing swelling of the oil and expansion of the $CO_2$ followed by expulsion of the oil and $CO_2$, and repeating the process until communication is established with another well. Other methods are also available.

THE DRAWINGS

In the accompanying drawings:

FIG. 1 is a cross section taken through an underground, oil-bearing formation and an installation of the invention therein in the form of two wells spaced apart for the recovery of oil;

FIG. 2, a detail of a small section of the matrix showing grains of rock with oil and water in the interstises;

FIG. 3, a schematic representation showing the control equipment associated with the wells for production of oil therefrom;

FIG. 4, a graph showing the relation between kinematic viscosity and temperature for several different crude oils; and FIG. 5, a graph showing the relationship between the ratio of the viscosity of oil saturated with $CO_2$ at 49° C. to the unsaturated viscosity as one parameter, and the saturation pressure as another parameter.

DETAILED DESCRIPTION OF THE ILLUSTRATED EMBODIMENT

Figure 1:
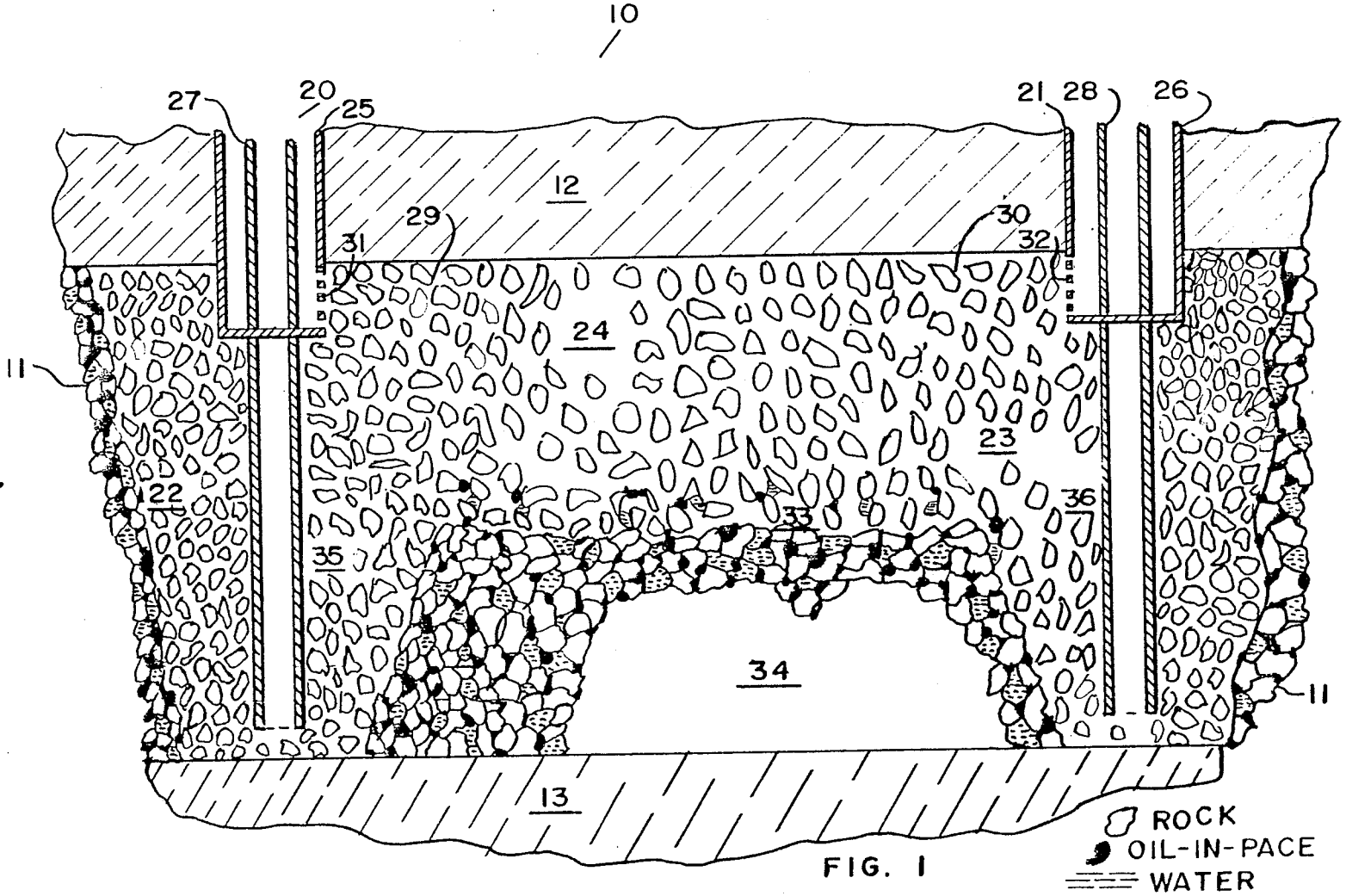

As noted above under the heading "State of the Art", existing EOR methods usually employ some variation of a flooding technique, such as chemical flooding, carbon dioxide flooding, or steam flooding. In each of these methods, substantially the entire vertical cross section of an oil-bearing matrix is subjected to a heated and/or pressurized flood of some substance, with the objective being to force the oil through the matrix to a production well. The method of the invention is uniquely different in that flooding is not employed, but instead a heated gas is flowed continuously through a channel within or alongside the matrix, primarily to transfer heat to the oil, and to solubilize gas into the oil, so as to lower its viscosity and thus to allow it to flow naturally to a specially prepared collection reservoir. This method is applicable to recovering even the highly viscous crudes locked in tar sands since the continuous flowing of fresh heated gas continuously supplies heat to oil-in-place in the sensible boundary, thus raising its temperature until it becomes sufficiently mobile. It is important to note that the temperature of the heated gas is high enough so as to significantly reduce viscosity but not so high as to cause vaporization or pyrolysis of significant quantities of the oil.

In addition, in accordance with the invention, there is a deliberate avoidance of miscibility of the carbon dioxide and the oil. Pressures and temperatures are purposely chosen low enough to avoid such miscibility. This is the reverse of the procedure employed in most existing EOR operations. The reason for this choice in this invention is to prevent the precipitation of solids, such as heavy paraffins and asphaltenes, that occur when the lighter hydrocarbons are pulled out of the oil by the carbon dioxide during a miscible process. Since the method employed in this invention for producing oil does not rely on miscibility for production, as do other methods, this precipitation can be avoided. The disadvantage of such precipitation is that the precipitated solids clog the pores and voids, thus trapping oil-in-place, and interfering with production. In addition, the high temperature and pressures involved in achieving miscibility result in greatly increased costs and potential hazards.

Still another important aspect of the invention lies in the deliberate solubilizing of carbon dioxide into the oil. This materially aids in reducing the viscosity.

It should also be noted that the method of the invention differs significantly from existing methods in the requirements relating to mobility ratio. In all existing methods, involving flooding, a low mobility ratio is essential. Otherwise fingering will interfer with production. A ratio as high as 10 is considered unsatisfactory. Attempts are made to achieve a ratio as close to 1 as possible. Thus, various substances are sometimes added to the flooding fluid to decrease its mobility. In the method of this invention, a low mobility ratio is not necessary, nor even desirable. Mobility ratios of 10, and even higher, such as 70 or more, present no problem. With limits, the higher the ratio the more heat will be transmitted to the oil-in-place in a unit of time and thus the greater the rate of production will be.

Still another advantage in the method of the invention lies in the removal of interstitial water, and in the conscious avoidance of the introduction of any additional water, whether as steam or condensate, into the matrix. The most common EOR practices in use today utilize steam, hot water, cold water, or some combination of these in some sort of a flooding technique. These practices account for about 2/3 of the oil recovered by EOR methods. Water, however, has several disadvantages. Notable among these are corrosion and scaling problems. Almost always the water available near oil fields is saline and/or contains a high percentage of dissolved solids. Unless dealt with, at considerable expense, equipment can be destroyed and wells plugged. In addition, water traps oil in pores of the matrix due to capillary action, especially in water-wet rock. This oil cannot be removed by continued flooding. In the method of the invention, the gas is dried before use so as to avoid the problems caused by water. In addition, the temperature is made high enough to vaporize any interstitial water that may initially exist, whence it is then removed along with the gas.

The specific details of the invention are as noted herewith.

Figure 2:
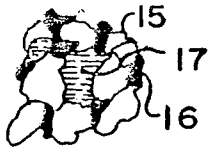

A typical underground oil-bearing formation is depicted at 10 in FIG. 1 Such formation comprises oil-in-place in a porous matrix 11 which is sandwiched between an impervious overburden 12 and an impervious underlayment 13. As best seen in FIG. 2, matrix 11 comprises a multiplicity of very small and closely spaced grains of rock 15 or other earth material having voids and pores between them, some of which contain oil 16 and some of which contain water 17. The water may be connate or left behind from a prior secondary phase.

In this instance, the apparatus of the invention comprises two wells 20 and 21, which extend through the impervious overburden 12 and terminate near the bottom of the matrix 11; two collection reservoirs 22 and 23, which surround and lie beneath the portion of the wells that extend into the matrix; and a channel 24, which communicates between the two wells, and which is pervious to a gas such as carbon dioxide ($CO_2$) . Channel 24 may lie within, or alongside, a portion of the matrix 11, from which portion the oil-in-place and water have been substantially depleted by means to be explained later.

Each collection reservoir, such as 22 or 23, comprises a portion of the matrix 11, that has been substantially depleted of oil-in-place and water by means to be described later and the lower portion of the wellbore 35 or 36. Thus, the collection reservoirs have voids and pores into which mobile oil can flow and collect.

Each well, such as 20 or 21, includes an outer conduit, such as 25 or 26, and an inner conduit, such as 27 or 28. Each outer conduit extends into the matrix 11 and communicates with a terminus, 29 or 30, of channel 24. Preferably each outer conduit conveys heated gas and each inner conduit conveys oil. Thus, heat from the heated gas inhibits solidifying of the oil.

The portions of each outer conduit 25 or 26 that interface with the channel 24 have openings 31 and 32 therein, through which a gas such as carbon dioxide, can flow, either from the conduit to the channel, or vice versa. Each inner conduit, 27 or 28, extends downward in the collection reservoir, 22 or 23, to a point near the bottom of the matrix 11, and is open so that oil can flow into it.

An interface 33 exists between channel 24 and the portion 34 of the matrix that lies between wells 20 and 21 and which contains the deposit of oil-in-place to be produced. This portion 34 is hereinafter called the reservoir. This interface is not sharply defined but comprises a relatively thin transition region between the channel 24 and the reservoir 34. This interface or transition region 33 is called hereinafter the sensible boundary between the channel and the reservoir. This sensible boundary can, and does, progress into the reservoir 34 as oil is produced, thus enlarging the channel 24 and reducing the size of the reservoir 34.

After the preparatory measures of establishing the collection reservoirs and the channel have been completed, equipment as necessary is emplaced and production is started. The production proceeds as follows, see FIG. 3.

Dry carbon dioxide in the gaseous state is introduced from tank 40 into compressor 43 through valve 42. This is then pressurized in compressor 43 to a value suitable for the particular formation and crude involved. As an example, for a very heavy and highly viscous crude, such as that of the Sunnyside, Utah tar sands, see FIG. 4, a pressure in the order of approximately 500 psia would be employed, whereas for a ligher crude, such as Gulf coast Crude, a pressure of approximately 200 psia would be employed. (Factors other than viscosity might also affect the pressures employed, such as porosity of the matrix, depth of the matrix, characteristics of the overburden, previous production methods, etc.)

Following pressurization, the carbon dioxide is then introduced into, and heated, in a heater 44 to a value suitable for the particular formation and crude involved. As an example, for the Sunnyside crude a temperature of approximately 800° F. would be employed, whereas for the Gulf Coast Crude a temperature of approximately 500° F. would be employed.

In any event, pressure and temperature are chosen low enough so as to avoid damage at the overburden, to prevent any substantial miscibility of the carbon dioxide and the oil, and to inhibit distillation of fractions of the oil, and yet high enough to impart mobility to the oil through increase in temperature and dissolution of the carbon dioxide into the oil, and to prevent precipitation out of the oil of solids such as paraffins and asphaltenes.

Figure 4:
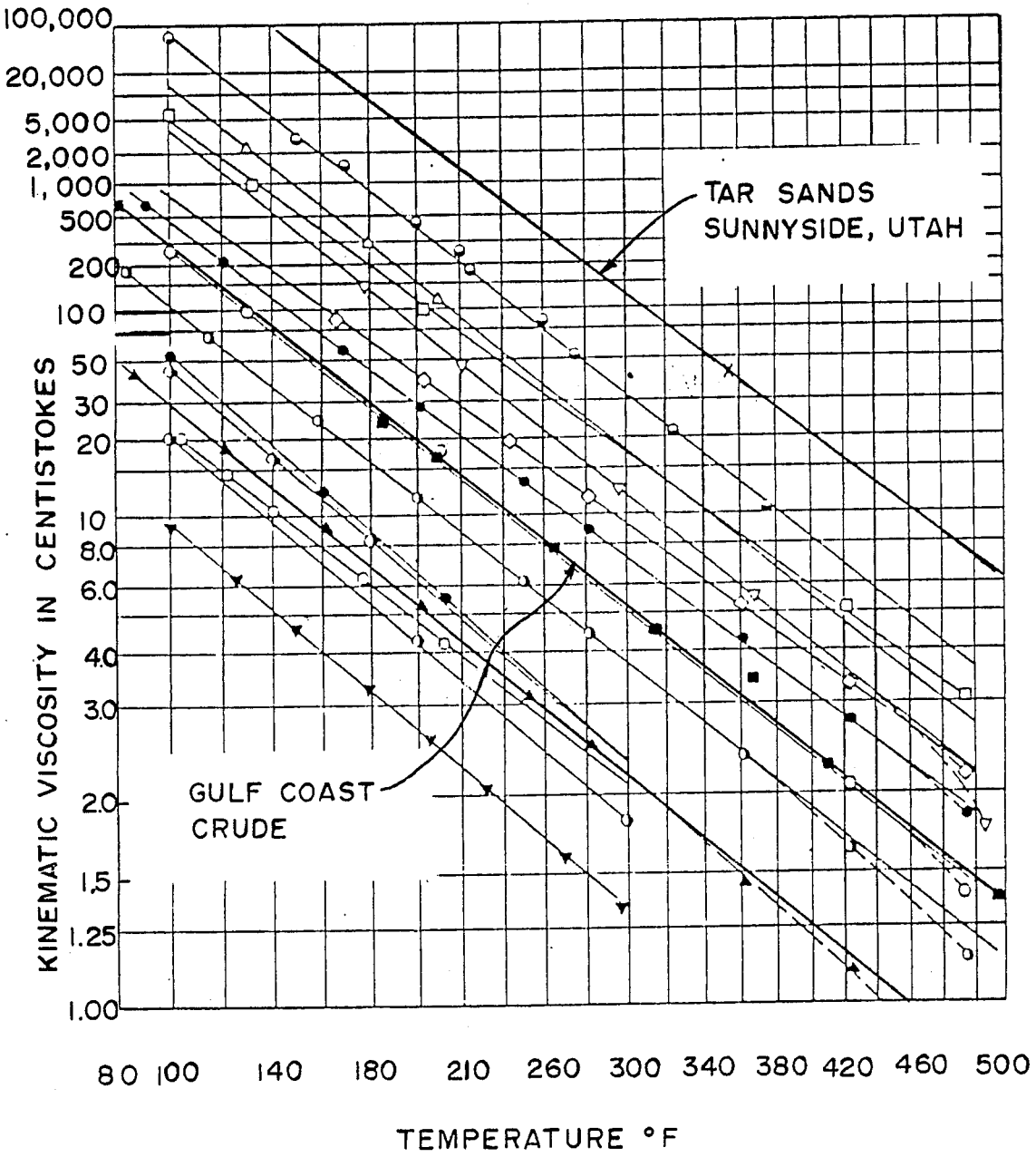
Figure 5:
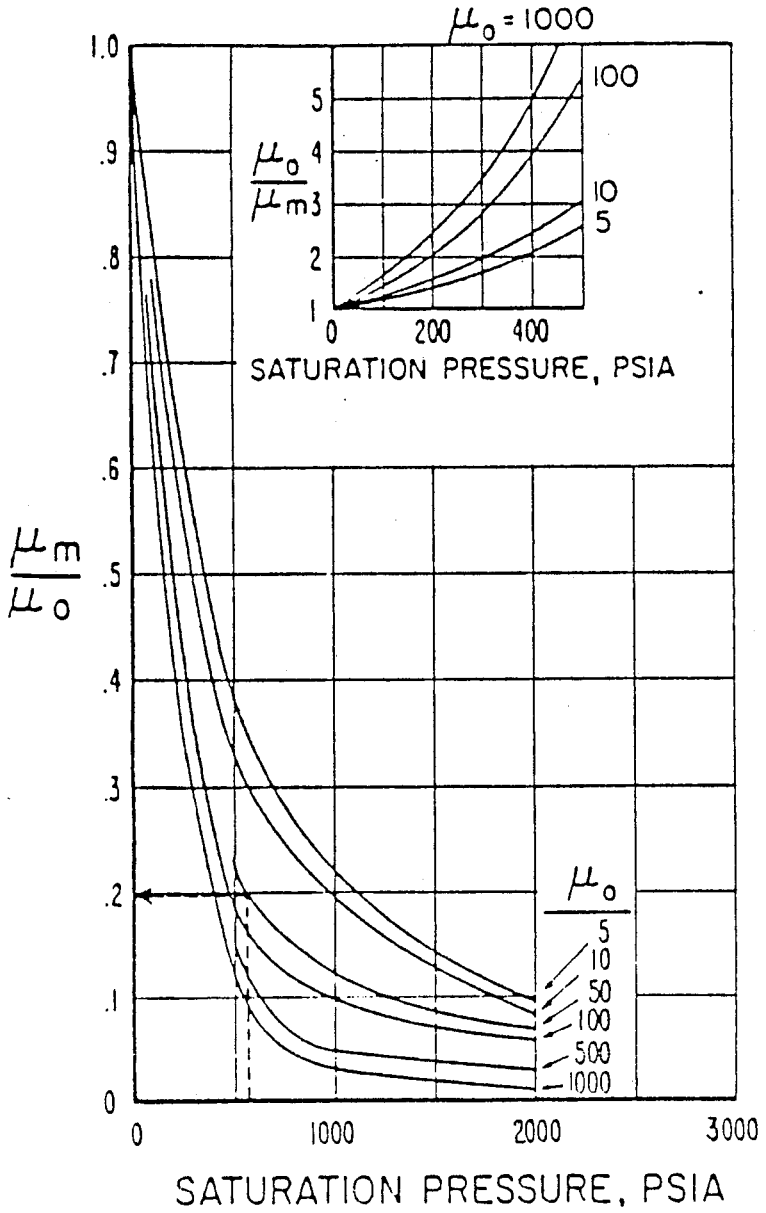

The effectiveness of moderately raising the temperature and pressure, and dissolving carbon dioxide into the oil, can be seen by referring to FIGS. 4 and 5. FIG. 4 is a graph showing the relationship between kinematic viscosity and temperature for several different crude oils, reproduced in part from FIG. 1 published in the Society of Petroleum Engineers Reprint Series No. 7, 1985 Edition, entitled, "Thermal Recovery Processes", and including an additional curve overlaid thereon. FIG. 5 is a graph showing the relationship between a first parameter, which is the ratio of the saturated viscosity to the unsaturated viscosity, and a second parameter, which is the saturation pressure, reproduced in part from FIG. 5, page 105 of Vol. 17, January 1965, of the Journal of Petroleum Technology.

As an example, if the temperature of the most viscous of the oils plotted, namely that of the Sunnyside, Utah tar sands, is raised to approximately 500° F., the kinematic viscosity will be reduced to less than 8 centistokes. In addition, if the pressure is raised to approximately 150 psia, the kinematic viscosity will be reduced to 5 or 6 centistokes. This represents a high degree of mobility. Where conditions allow, the pressure can be raised even higher, in which case, the kinematic viscosity will be reduced even further.

Following heating, the carbon dioxide is flowed through valve 45 into conduit 25 in well 20, from whence it exits through openings 31 into terminus 29 of channel 24. A substantial portion of the carbon dioxide then flows to terminus 30 of channel 24, then through openings 32 into conduit 26. It then flows through valve 46 into receiving receptacle 47, where it is separated from foreign substances, such as oil, water, and other impurities. It is then fed through valve 48 into tank 40 and repeats its cycle. Oil and impurities in the oil are fed into receiving receptacle 62 through valve 66. Since some of the carbon dioxide will be lost, or expended, in the cycle, makeup carbon dioxide is supplied from tank 40.

As the carbon dioxide flows through channel 24, its temperature and pressure will decrease. The spacing between the wells, and also other parameters, are so chosen that for the Sunnyside crude the exiting temperature of the carbon dioxide is approximately 500° F. and the pressure approximately 150 psia. For the Gulf Coast Crude the corresponding values are 300° F. and 50 psia, respectively.

As the carbon dioxide flows through channel 24, it imparts heat into the oil and also into the water and rock in the matrix. Naturally, the oil closest to the sensible boundary will be heated the most. Likewise, some of the carbon dioxide will dissolve into the oil. As shown above, both of these actions reduce the viscosity of the oil, rendering it mobile.

Assuming that the oil in the deposit is similar to that in the Sunnyside tar sands and that the sapcing of wells 20 and 21, and other parameters are established such that the temperature at well 21 is at least 500° F. and the pressure at least 150 psia, the kinematic viscosity of the mobilized oil will be less than 6 centistokes, which represents a high degree of mobility. Naturally in regions closer to well 20 the viscosity will be even lower. Thus, the oil will flow, under the influence of gravity, assisted by gas pressure, into collection reservoirs 22 and 23. After a collection reservoir has substantially filled, its corresponding valve 60 or 61 is opened and the oil is produced through conduit 27 or 28 and into receiving receptacle 62, assisted by pump 64 or 65, respectively, as needed. The carbon dioxide dissolved in the oil is then separated from the oil, by means well known in the art and not described here. The separated carbon dioxide may then be reintroduced into tank 40 through valve 63. Likewise, in receiving receptacle 62 sulfur, sand, and other undesired substances are separated from the oil by means well known in the art and not described here.

As the heated carbon dioxide flows through channel 24, it vaporizes any water residing in the matrix in or near the sensible boundary. This then mingles with the gas and is extracted with the gas through conduit 26. This water is then removed from the carbon dioxide in receiving receptacle 47 by a drying process well known in the art and not described here.

As the oil and water are extracted from the sensible boundary, pores and voids in the matrix will be emptied, leaving new spaces in which the carbon dioxide can flow. Thus, in effect, the channel is enlarged and the sensible boundary is moved farther into the reservoir 34. This can continue until reservoir 34 is substantially depleted of oil-in-place.

Since heat is being continuously supplied, the rock portions of the matrix do not cool down but become heated progressively deeper into the matrix. This serves to heat the oil and thus is not completely lost.

Some distillation of lighter fractions of the oil may occur. However, for the heavy oils as in tar sands the amount of such lighter fractions present, and thus distilled, will be small. Some of this may find its way into the collection reservoirs and some may be extracted with the carbon dioxide. This latter can be separated from the carbon dioxide, if in sufficient quantity, in receiving receptacle 47 by means well known in the art and not described here.

It may be found advantageous from time to time to reverse the flow of the carbon dioxide in channel 24. This can easily be done by operating valve 45 so as to inject into well 21 through conduit 26, and by operating valve 46 so as to extract from well 20 through conduit 25. This will serve to equalize conditions at collection reservoirs 22 and 23 and sensible boundary 33.

As noted above, preparatory measures must be effected before oil production can commence. One of these entails the establishment of a collection reservoir surrounding, and beneath, each well. Various procedures may be employed to accomplish this, such as the following.

Wellbores 35 and 36 for wells 20 and 21, respectively are bored down to the bottom of the wells. A pressurized heated gas, such as carbon dioxide, at approximaty 2,000° F. and 100 psia, is injected into well 20 by way of conduits 25 and 27 and into well 21 by way of conduits 26 and 28, respectively. This gas will mobilize, and even volatilize, water and oil-in-place that it contacts. The pressure is then released and the gas, water, and oil extracted from the well by pumping or other means of evacuation. This process is repeated until the desired collection reservoir is established.

Another method, suitable only for deep-wells, is to inject carbon dioxide at approximately 500° F. and 1000 psia. Some of the carbon dioxide will dissolve into oil that it contacts. The pressure is then suddenly released, causing the water to vaporize, the oil to swell, and the carbon dioxide to expand, followed by expulsion of oil and gas from the matrix in a reverse direction and then from the well. Naturally, some oil will be produced during this process.

Somewhat similar methods may be employed to create channel 24. However, in this instance it may be expeditious to drill one or more wells intermediate between wells 20 and 21, extending down into the desired channel region, and repetitively injecting and extracting heated pressurized gas into, and from, each. In addition to voids and pores being emptied of oil and water, some longitudinal cracks and fissures may be created due to the repeated expansion and contraction of the matrix.

If desired, the channel may be formed at an intermediate depth of the reservoir rather than at its upper extremity. Likewise, two or more channels may be formed, one spaced apart from, and beneath, the other. This could be useful for reservoirs having an extensive thickness or for formations having two or more reservoirs.

Figure 3:
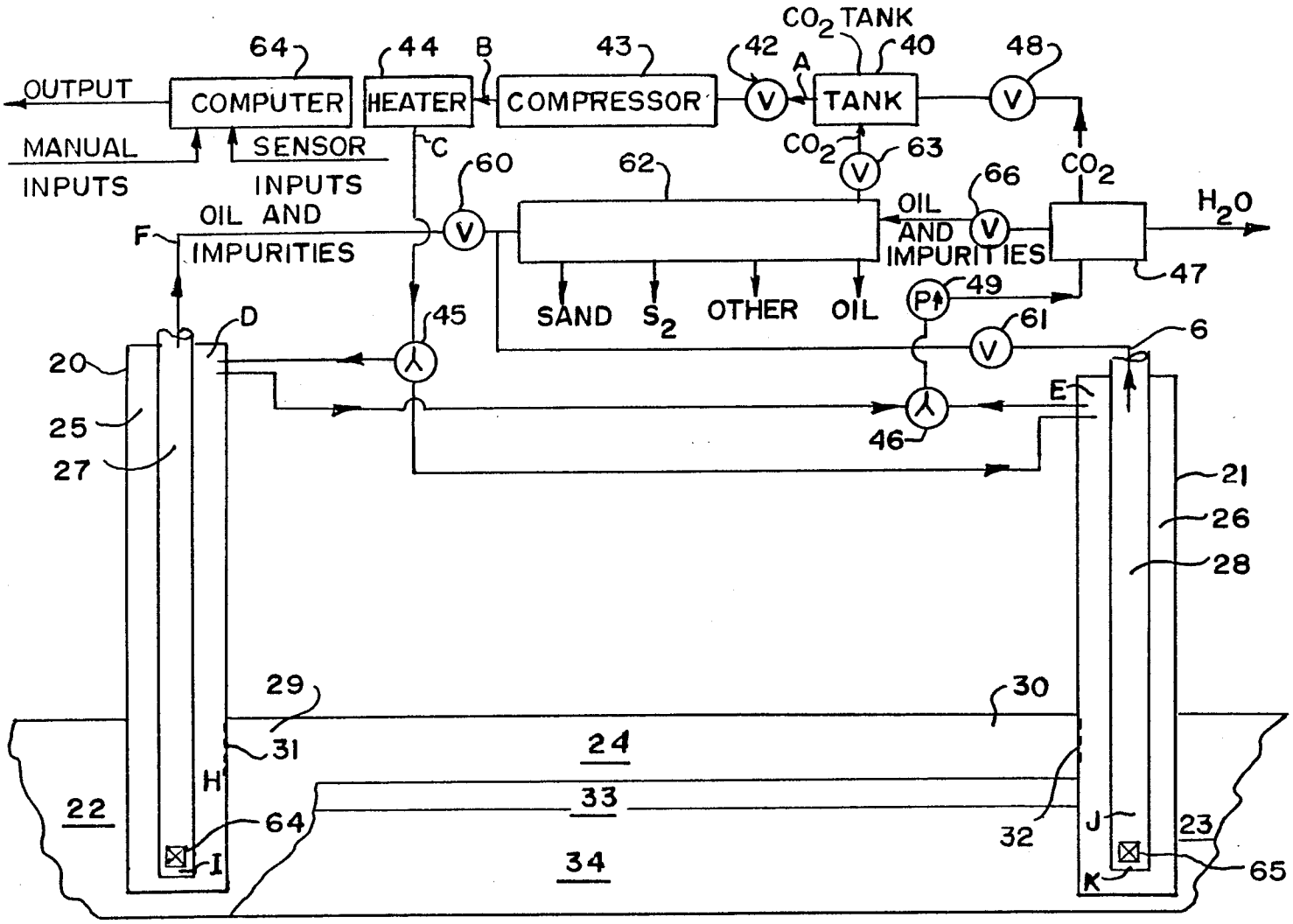

If desired, the production process may be substantially automated as described herewith, see FIG. 3.

A computer 64 is employed to receive inputs and to transmit signals to operate valves and other equipment as needed. The internal details of the computer are well known in the art and are not described here. Some of the inputs to the computer would be fed in manually, such as the desired input and output temperatures, pressure, and flow rate of the carbon dioxide, and the direction of flow of the carbon dioxide in channel 24. Other inputs would come from sensors that indicate temperature, pressure, liquid level, and flow rate, located at points, such as A, B, C, D, E, F, G, H, I, J, and K and others as needed.

In operation, signals from sensors at point A, C, D, and E would be transmitted to the computer which would perform the necessary computations and then transmit signals to valve 42 to control the flow rate of the carbon dioxide. Likewise, signals from sensors at point B, C, D, and E would be transmitted to the computer which would then transmit signals to compressor 43 to control the pressure of the carbon dioxide. Similarly, signals from sensor C would be transmitted to the computer which would then transmit signals to heater 44 to control the temperature.

Signals from sensors at point D or E, depending on which well was being used for extraction of the carbon dioxide, would enter the computer which would then actuate a display to notify the operator of the exiting temperature, pressure, and flow rate of the exiting carbon dioxide so that he could make judgmental adjustments of the manual inputs to the computer, if desired.

Similarly, signals from sensors located at points F and G would enter the computer which would then actuate displays to advise the operator of temperature and flow rate of the oil being produced at each well. These could prompt the operator to make adjustment of the manual inputs. One such adjustment could be to reverse the direction of flow of the carbon dioxide through channel 24. In response to such a manual command, the computer would transmit signals to valves 45 and 46 to alter the flow through them as needed so as to reverse the flow through channel 24.

In addition, high-level sensors at points H and J would transmit signals to the computer to indicate that oil has filled the corresponding reservoirs 22 or 23, whence the computer would then signal valve 60 or 61 to open, and pump 64 or 65 to start pumping, if necessary, to raise the oil to the surface. In a similar manner, lowlevel sensors I and K would signal the computer that oil has been substantially depleted from the corresponding reservoirs 22 or 23, whence the computer would then signal valve 60 or 61 to close and pump 64 or 65 to stop.

Signals from the computer may also be employed to control other equipment, such as vacuum pump 49 and valves 48, 63, 66, and others as desired.

A pattern of wells may be established in an extensive oil field, such that as a well is depleted of oil the piping and controls may be connected to another well. There are several configurations for such wells in an oil field which are known in the industry and need not be described here.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

APPENDIX OF TERMS

Collection Reservoir

A portion of the reservoir, that has been substantially depleted of oil-in-place and water, is in close proximity to a production well, and serves to collect oil being produced.

Flooding

A process wherein a pressurized fluid is injected into an injection well penetrating an oil-bearing formation such that the entire thickness, or a substantial portion thereof, of the oil-bearing matrix is interfaced by the fluid, and so pressurized that an expanding substantially cylindrical volume of the fluid expands into the matrix, reacting with and/or pushing the oil in the matrix towards one or more production wells spaced apart from the injection well.

Matrix

The natural material in which the oil is embedded.

Miscible

Able to mix together; refers to two or more substances. A miscible process is one in which there is a transfer of matter, such as hydrocarbons, from the oil to a fluid, such as carbon dioxide.

Oil-In-Place

Oil located in a formation in its natural state.

Reservoir

A discrete section of porous rock containing an accumulation of oil-in-place.

Sensible Boundary

A relatively thin portion of the matrix in an oil-bearing formation that is sandwiched between a channel, that has been substantially depleted of oil-in-place and water, and the reservoir containing oil-in-place. Thus, this sensible boundary does not denote a distinct line of demarcation but represents a transition zone between the channel and the reservoir.

I claim:

1. A thermal method for producing oil from a natural reservoir of oil distributed throughout an underground oil-bearing formation, comprising the steps of continually flowing a pressurized heated non-aqueous gas along and in heat exchange relationship with a sensible boundary of said reservoir so as to impart sufficient heat and dissolve sufficient gas into oil-in-place which is in close proximity to said boundary of said reservoir to mobilize said oil-in-place by decreasing its viscosity; effecting flow of said mobilized oil into one or more collection reservoirs; producing said oil from said one or more collection reservoirs; and extracting at least some of the gas with reduced heat content from said formation.

2. A method in accordance with claim 1, wherein the gas is carbon dioxide ($CO_2$).

3. A method in accordance with claim 1, wherein the gas is natural gas.

4. A method in accordance with claim 1, wherein the gas is nitrogen.

5. A method in accordance with claim 1, wherein the gas is flue gas.

6. A method in accordance with claim 1, wherein the gas is a mixture of two or more gases.

7. A method in accordance with claim 1, wherein at least a portion of said gas is continuously recycled.

8. A method in accordance with claim 1, wherein the temperature of the gas is maintained below the calcining point of the formation.

9. A method in accordance with claim 1, wherein the temperature of the gas is maintained below the distillation temperature of the bulk, by weight, of the oil.

10. A method in accordance in claim 1, wherein the temperature and pressure of the gas are maintained below the point of substantial miscibility of the gas and the oil.

11. A method in accordance with claim 1, wherein the mobility of the gas is more than ten times the mobility of the oil-in-place.

12. Means for establishing a collection reservoir or channel in an oil-bearing formation and simultaneously producing some oil, comprising a well extending into the oil-bearing formation; means for injecting into said well a pressurized heated gas which dissolves into the oil; means for releasing the pressure, thus resulting in swelling of the oil and expansion and expulsion of the gas and the oil through the well; and means for repeating said injection and expulsion a sufficient number of times to progressively establish the desired collection reservoir or channel.

* * * * *